US006242721B1

(12) United States Patent
Borrmann et al.

(10) Patent No.: US 6,242,721 B1
(45) Date of Patent: Jun. 5, 2001

(54) COOKTOP WITH A NON-METALLIC HOTPLATE

(75) Inventors: Andreas Borrmann, Ingelheim; Dieter Munkes, Langenlonsheim; Kurt Schaupert, Hofheim; Harry Engelmann, Bingen, all of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/284,029

(22) PCT Filed: Jan. 7, 1998

(86) PCT No.: PCT/EP98/00194

§ 371 Date: Apr. 6, 1999

§ 102(e) Date: Apr. 6, 1999

(87) PCT Pub. No.: WO98/31198

PCT Pub. Date: Jul. 16, 1998

(30) Foreign Application Priority Data

Jan. 11, 1997 (DE) ..... 197 00 753

(51) Int. Cl.[7] ..... H05B 1/02; H05B 3/68

(52) U.S. Cl. ..... 219/518; 219/446.1

(58) Field of Search ..... 219/490, 497, 219/509, 518, 446.1, 447.1

(56) References Cited

U.S. PATENT DOCUMENTS

| | | | | |
|---|---|---|---|---|
| 4,319,109 | * | 3/1982 | Bowles | 219/518 |
| 4,334,135 | | 6/1982 | Smith . | |
| 5,136,277 | * | 8/1992 | Civanelli et al. | 219/518 |
| 5,424,512 | * | 6/1995 | Turetta et al. | 219/518 |
| 5,491,423 | * | 2/1996 | Turetta | 219/518 |
| 5,893,996 | * | 4/1999 | Gross et al. | 219/518 |

FOREIGN PATENT DOCUMENTS

| | | |
|---|---|---|
| 238 331 | 2/1965 | (AT) . |
| 33 27 622 A1 | 2/1985 | (DE) . |
| 37 33 108 C1 | 2/1989 | (DE) . |
| 35 33 997 C2 | 6/1991 | (DE) . |
| 37 11 589 C2 | 12/1992 | (DE) . |
| 0 429 120 A2 | 6/1991 | (EP) . |
| 0 442 275 A2 | 8/1991 | (EP) . |
| 469 189 A2 | 2/1992 | (EP) . |
| WO 90/07851 | 7/1990 | (WO) . |

* cited by examiner

*Primary Examiner*—Sang Paik
(74) *Attorney, Agent, or Firm*—Michael J. Striker

(57) ABSTRACT

The cooktop has a cooking zone (2), at least one electric heating unit (7, 7') assigned to the cooking zone (2) and a device for detecting a metal pot on the cooking zone (2) and determining its size when the metal pot is resting on the cooking zone (2). The device for detecting the presence and advantageously the size of the metal pot includes a measuring sensor (3) arranged near the cooking zone (2) and one or more evaluation devices (5, 5") communicating with the measuring sensor (3). The measuring sensor (3) includes a primary measuring coil (8) and one or more secondary measuring coils. The primary measuring coil terminals (**8*a*, 8*b*) are electrically connected with corresponding poles of an alternating voltage generator (4) for generating an alternating current in the measuring coil (8) and a magnetic alternating testing field that interacts with the one or more secondary measuring coils to induce a voltage in them. The respective evaluation devices (5, 5") include comparators (15,15") for comparing the induced voltages in the corresponding secondary measuring coils (9,20) with voltage threshold values to detect the presence and advantageously the size of a metal pot placed on the cooking zone (2**) as a result of eddy currents produced in the metal pot.

19 Claims, 6 Drawing Sheets

1
2
3
8
9
20
18
19
10
11a
11b
11
12a
12b
12
12a''
12b''
12''
4
17
16a
22
16b
14
13
15
5
6
7
17''
22''
16a''
16b''
14''
13''
15''
6''
7''
5''

COOKTOP WITH A NON-METALLIC HOTPLATE

BACKGROUND OF THE INVENTION

1. Field of the Invention

The invention relates to a cooktop with a nonmetallic hotplate, in particular a glass ceramic hotplate, which has at least one cooking zone to which an electric heating unit is assigned, and having a device for detecting the presence and/or size of metal pots on the cooking zone, which has a measuring sensor disposed in the region of the cooking zone and an evaluation device communicating with the measuring sensor.

2. Prior Art

A cooktop with a switching device for supplying energy to the heating unit is known from Austrian Patent 238 331. The switching device enables the supply of energy to the heating unit when the pot is put on the stove and interrupts the supply of energy when the pot is removed. Detecting the pot on the cooking surface is done by means of a proximity switch, which is not defined in further detail in this patent.

German Patent Disclosures DE-A 35 33 997 and DE-A 33 27 622 describe pot detection systems with optical sensors. Pot detection systems with inductive sensors are known from German Patent Disclosures DE-A 37 11 589 and DE-A 37 33 108.

The known inductive proximity switches are based on the principle of the damping of an oscillation circuit caused by eddy current losses in metals that are located in the magnetic stray field of the sensor coil. It is a disadvantage that the coil may have many windings to achieve adequate sensitivity. Furthermore, changes in the electrical properties of the coil material, at the high temperatures that occur in the cooking zones of the cooking surface, cause a temperature drift of the measurement signal, which is on the order of magnitude of the signals caused by putting the pots on the stove or taking them away. To avoid measurement errors from temperature changes, it is known to evaluate rates of signal change. In that case, a relatively complicated temperature compensation can be omitted.

European Patent Disclosures EP-A 0 442 275 and EP-A 0 469 189 describe pot detection systems of this kind that have an inductive sensor in the form of a coil that is part of an oscillation circuit. To make it possible to distinguish between the signal change when the pots are put on the stove or taken away from the signal change that can be ascribed to temperature changes, the different rate of signal change is detected, which differs markedly when pots are put on the stove or taken away from the rate of signal change caused by temperature changes. It is disadvantageous, however, that the above systems must be located permanently in the readiness state, because pots can be detected only when they are put on the stove or taken away. Conversely, static pot detection is not possible.

Capacitive sensors for pot detection are known from International Patent Disclosure WO 90/07851 and European Patent Disclosure EP 0 429 120. These sensors are disadvantageous in the sense that only small useful signals, which are hard to evaluate, are obtained, and the systems are vulnerable to electromagnetic factors. Moreover, the measurement signals can be affected by nonmetallic materials, such as the hands of a person, damp cloths, etc.

From U.S. Pat. No. 4,334,135, a pot detection system for an inductively heated glass ceramic cooktop has become known, in which a receiving coil that detects the changes in the magnetic field caused by a pot placed on the stove is disposed above the induction heating coil.

Heating coils for induction devices in general utilize ferritic parts to carry the field; they are disposed below the induction heating coil. If no pot is placed on the stove, the circuit is not closed, and the field must pass through the air. When a pot is placed on the stove, the field is guided in the ferritic material and amplified. The receiving coil, located in the space between the induction heating coil and the pot, is engaged by this amplified field and outputs an amplified signal.

The principle of operation of the known device is the principle of the magnetic circuit closed by the pot and the accordingly increased magnetic flux; that is, in the known case, the signal increases when pot is placed on the stove.

In principle, this effect works only with ferromagnetic pots and pans; that is, it does not work with pots and pans of special steel, aluminum, or copper, but for induction devices this is not a restriction because such devices can be operated only with such pots and pans anyway. The relative permeability of the material comprising the pot is decisive for the function.

The known pot detection system is therefore disadvantageously limited to inductively heated cooking zones.

Another disadvantage of the known case is that two coils connected counter to one another are needed to detect pots and pans that have shifted position. Detecting pots and pans of different sizes to control a two-circuit heating body is not contemplated in the known case.

SUMMARY OF THE INVENTION

The object of the invention is to create an apparatus which with high reliability and by simple means, even for various configurations of pots, makes it possible to detect metal pots of all types on a cooking zone of a nonmetallic hotplate that has cooking zones heated in other ways than inductively.

This object is attained according to the invention in that the measuring sensor has at least one primary measuring coil for generating a magnetic alternating testing field and at least one secondary measuring coil, which are disposed in the same plane in such a way that the secondary measuring coil is penetrated by the magnetic alternating testing field of the primary measuring coil, and the evaluation device monitors the voltage induced in the secondary measuring coil and detects any change in the induction voltage as a consequence of the eddy currents occurring in a pot in order to detect the presence and/or size of the pot.

Pot detection in the apparatus of the invention is based on the effect of conductive materials on the transformer-type coupling of two coils. The measuring sensor has at least one primary coil to generate a magnetic alternating field and a secondary coil, which is disposed in such a way that it is penetrated by the magnetic alternating field of the primary coil. The magnetic field generates an eddy current in the metal pot, and this eddy current in turn generates a magnetic field counteracting its cause, which causes a decrease in the induced voltage in the secondary coil.

Since the level of the induction voltage is dependent on the size or shape of the pot, the pot size or shape can also be ascertained.

To detect pots that have shifted in position, advantageously only one coil is needed. To detect pots and pans of different sizes in order to control a two-circuit heating body, two receiving coils are provided, or the differential reduction in the signal is utilized.

The change in the induction voltage is largely independent of the ferromagnetic properties of the pot and in particular the base of the pot. Conversely, the conductivity is the decisive variable. Although such pot materials as special steel, iron, copper and aluminum differ markedly on their ferromagnetic behavior, it is nevertheless possible to detect both the presence of a pot and the size of the pot with high reliability. Materials other than metallically conductive materials, such as hands, damp cloths, etc. that are introduced into the magnetic alternating field cannot cause malfunctions.

Metal pots are understood here not only to mean pots made entirely of metal material, but also pots that include metal parts. To detect a pot, it suffices if at least some parts of it are conductive.

The metal pots that are introduced into the magnetic alternating field can lead to an increase or decrease in the total voltage induced in the secondary coil, depending on the geometric arrangement of the primary and second coils. Both effects can be detected by the evaluation device and utilized to detect the presence and/or size of the pots.

The measuring sensor allows static pot detection; that is, on being turned on, the measuring sensor detects whether a pot is located on the cooking zone, and how large the pot is. There is no need to evaluate rates of signal change. It suffices to compare the induction voltage with a reference voltage that is characteristic for the presence of a pot or for the pot size.

In a preferred embodiment, the evaluation unit in which the change in the induction voltage is detected for pot detection has a comparator. The comparator compares a signal that is proportional to the voltage induced in the secondary measuring coil with a threshold value characteristic for the presence of a pot, so that when the threshold value is reached, it can be concluded that a pot is present. To detect different pot sizes, a comparator can be provided that compares the signal with threshold values characteristic for pots of different sizes.

To detect the presence of a pot and/or the pot size, in principle only one primary coil and one secondary coil are needed. The magnetic alternating field, however, can also be generated with a plurality of primary coils. For instance, primary coils each assigned to the individual cooking zones can be connected in series.

The detection of different pot sizes can be done with increased accuracy if for each pot size that is to be detected, one secondary coil is provided, each of which is assigned a comparator with a threshold value characteristic for that particular pot size. The individual coils can be embodied independently of one another, in such a way that for that particular pot size, an especially significant change in the induction voltage can be demonstrated.

The coils of the measuring sensor are embodied as air coils and disposed in the same plane. In a preferred feature, the coil are embodied as conductor tracks, which are applied to a supporting plate, preferably the underside of the glass ceramic cooking surface. Since adequate sensitivity is also achieved with coils that have only one winding, the conductor tracks can be embodied in the form of loops. This arrangement has the advantage that contacting in the middle region of the coil, which is preferably located inside the cooking zone, is unnecessary.

The primary and secondary coils can be disposed in such a way that the area encompassed by the conductor loop of the primary coil is located inside the area encompassed by the conductor loop of the secondary coil, or the area encompassed by the secondary coil is located inside the area encompassed by the primary coil. Arrangements are also possible in which the primary and secondary coils are located side by side and do not enclose any common area. The sole decisive factor is that the secondary coil be penetrated by the alternating magnetic field of the primary coil.

Compensation for the temperature dependency of the measuring sensor, which can be ascribed to a changing resistance of the primary coil caused by the temperature increase during cooking, is advantageously effected by means of a constant exciting current. The evaluation can therefore be done with fixed threshold values, or in other words threshold values that are independent of the temperature.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
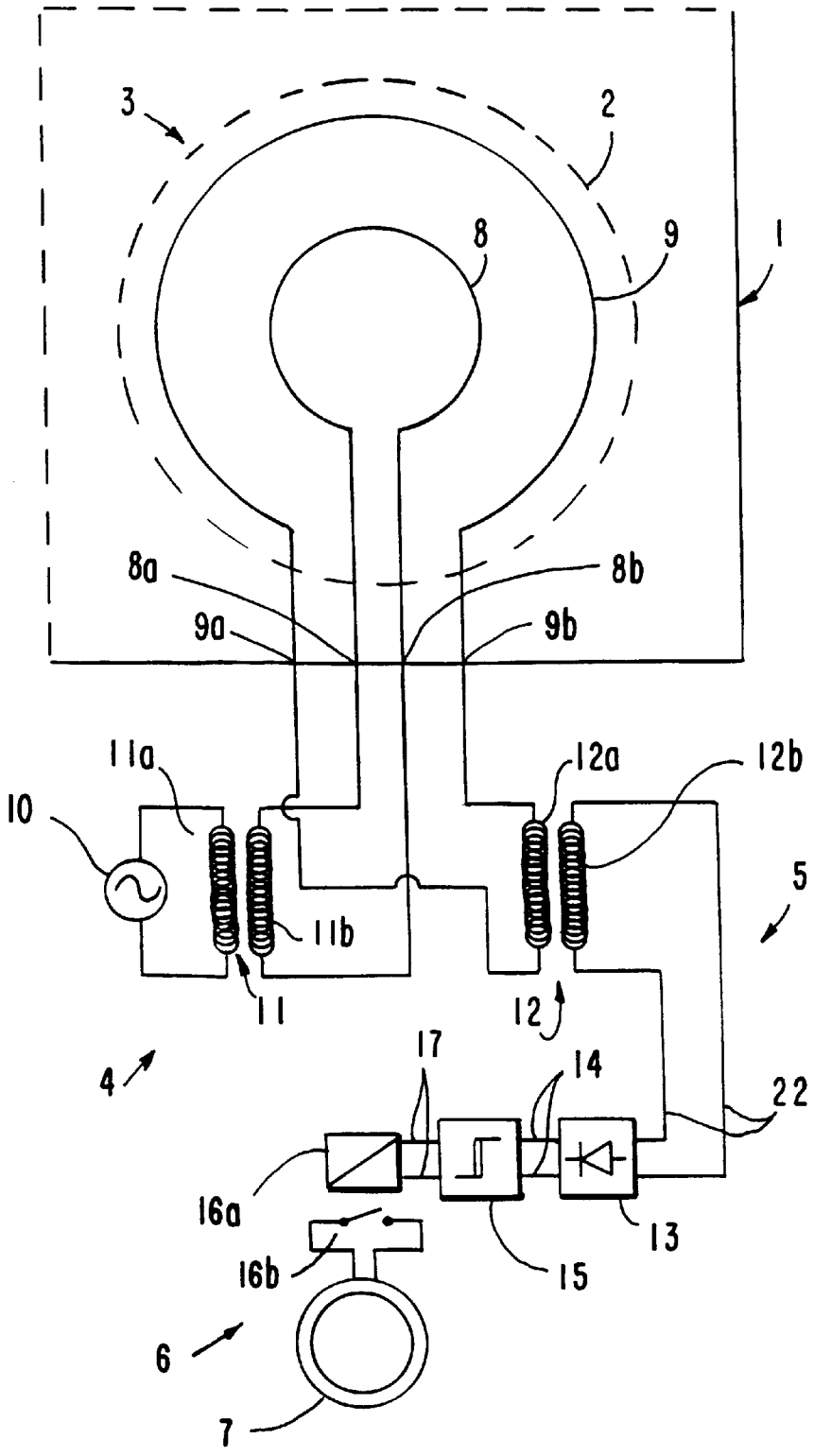
FIG. 1. is the block circuit diagram of a preferred embodiment of an apparatus for detecting the presence of a pot on the cooking zone of a stove that has a glass ceramic cooking surface.

The glass ceramic cooking surfaces of the known stove have a plurality of cooking zones. One of the cooking zones of the glass ceramic cooking surface 1, shown only in suggested fashion in FIG. 1, is represented by a dashed line 2.

The apparatus for pot detection has a measuring sensor 3, shown in suggestion fashion in the region of the cooking zone 2; an alternating voltage generator 4; an evaluation unit 5; and a control or switching unit 6 for the heating unit 7 of the cooking zone.

The measuring sensor 3 comprises a circular-annular primary coil 8 with the terminals 8*a*, 8*b* and a circular-annular secondary coil 9 with the terminals 9*a*, 9*b*. The two coils 8, 9 are embodied as conductor loops, which are applied to the underside of the cooking surface inside the cooking zone; the primary coil 8 is surrounded by the secondary coil 9. Alternatively, however, it is also possible for the secondary coil to be surrounded by the primary coil.

The alternating voltage generator 4 has an alternating voltage source 10, which is connected to the primary winding 11*a* of a transformer 11, to whose secondary winding 11*b* the primary coil 8 of the measuring sensor 3 is connected.

The evaluation unit 5 also has a transformer 12 for ungrounded coupling; its primary winding 12*a* is connected parallel to the secondary coil 9 of the measuring sensor 3. A rectifier 13 is connected to the secondary winding 12*b* of the transformer 12 via two signal lines 22 and to a comparator 15 via two further signal lines 14.

The control or switching unit 6 has a relay 16*a*, by way of whose switch contact 16*b* the energy supply to the heating unit 7 is interrupted. The relay is connected to the signal output of the comparator 15 over two signal lines 17.

During operation, the primary coil 8 of the measuring sensor 3 experiences a flow of high-frequency alternating current through it, so that an alternating magnetic field that penetrates the secondary coil 9 is generated. The alternating voltage induced in the secondary coil 9 is picked up via the transformer 12 of the evaluation unit 5 and is rectified in the rectifier 13.

If a metal pot is placed on the cooking surface, this causes a change in the induction voltage because of the eddy currents generated in the metal material of the pot, which generate a magnetic field that counteracts the alternating magnetic field.

The decrease in the induction voltage is ascertained in the comparator 15, which compares the voltage with a threshold value characteristic for the presence of a pot. If the threshold value is undershot, a control voltage is applied to the signal output of the comparator 15, so that the switch contact 16*b* of the control or switching unit 6 is closed and the heating unit 7 is activated. When the pot is removed from the cooking surface, the induction voltage is below the threshold value, so that the switch contact 16*b* is interrupted and the heating unit 7 is deactivated.

Figure 2:
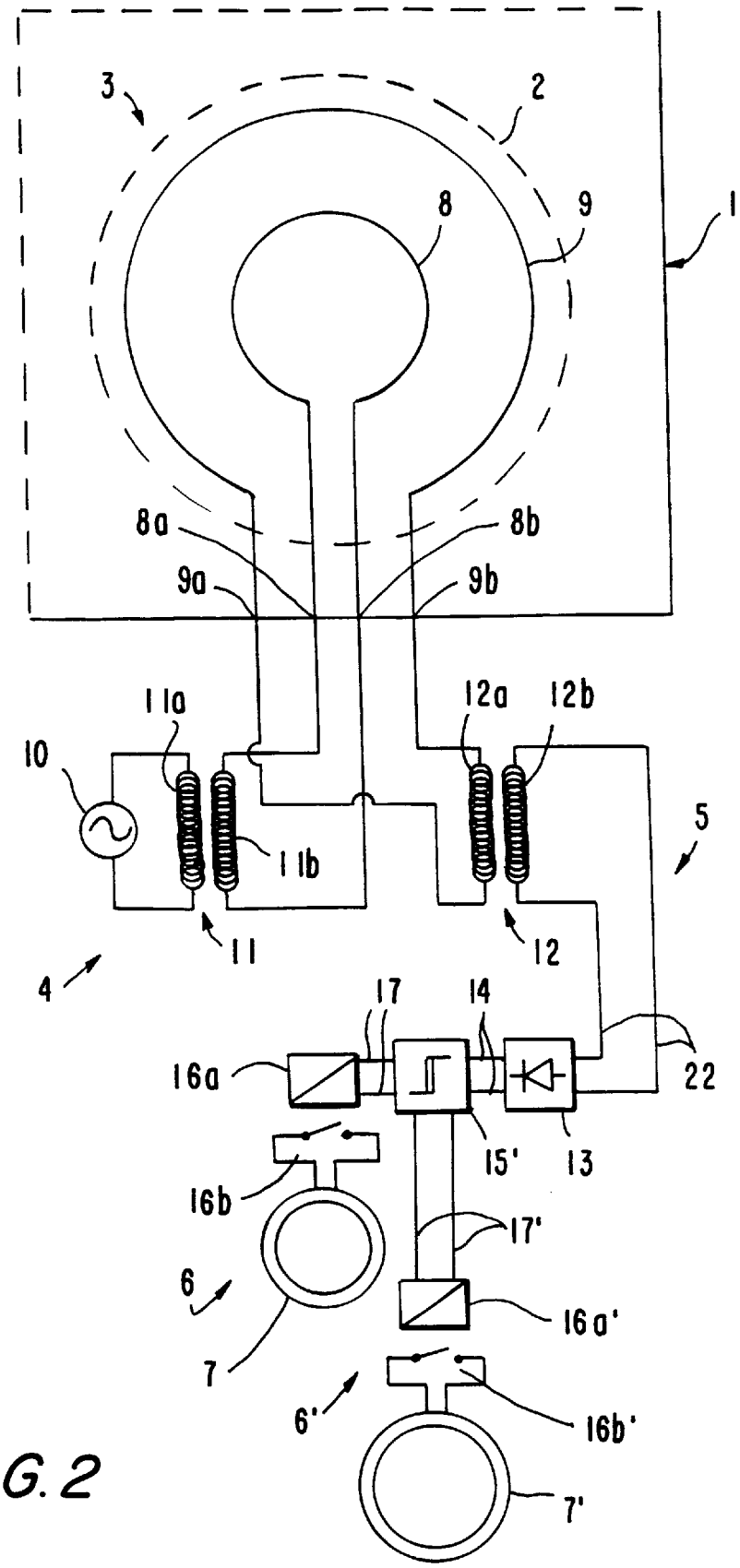
FIG. 2. is the block circuit diagram of a preferred embodiment of an apparatus that enables the detection both of the presence of a pot and the size of the pot.

FIG. 2 shows a further embodiment of the apparatus, in which those parts that correspond to the elements described in the exemplary embodiment of FIG. 1 are provided with the same reference numerals. The embodiment of FIG. 2 makes it possible not only to detect the presence of a pot on the cooking zone of a stove but also to ascertain the pot size. To that end, the comparator 15' is embodied as a threshold value switch with two threshold values; the first threshold value is higher than the second threshold value. The second signal output of the comparator 15' is connected over the control lines 17' with the relay 16*a'* of a second control or switching unit 6' for a second heating unit 7, and this second heating unit is activated when the switch contact 16*b'* closes.

If no pot is placed on the cooking zone 2, the induction voltage of the secondary coil 9 is above the two threshold values, so that the switch contacts 16*b* and 16*b'* are opened and both heating units 7, 7' are deactivated. If a pot with a small diameter is put on the stove, so that the induction voltage is below the first threshold value but above the second threshold value, then only the first heating circuit is activated by closure of the first switch contact 16*b*. The second heating circuit is then turned on by the closure of the second switch contact 16*b'* if a pot with a larger diameter is put on the stove, causing the induction voltage to be below both the first and the second threshold value.

Figure 3:
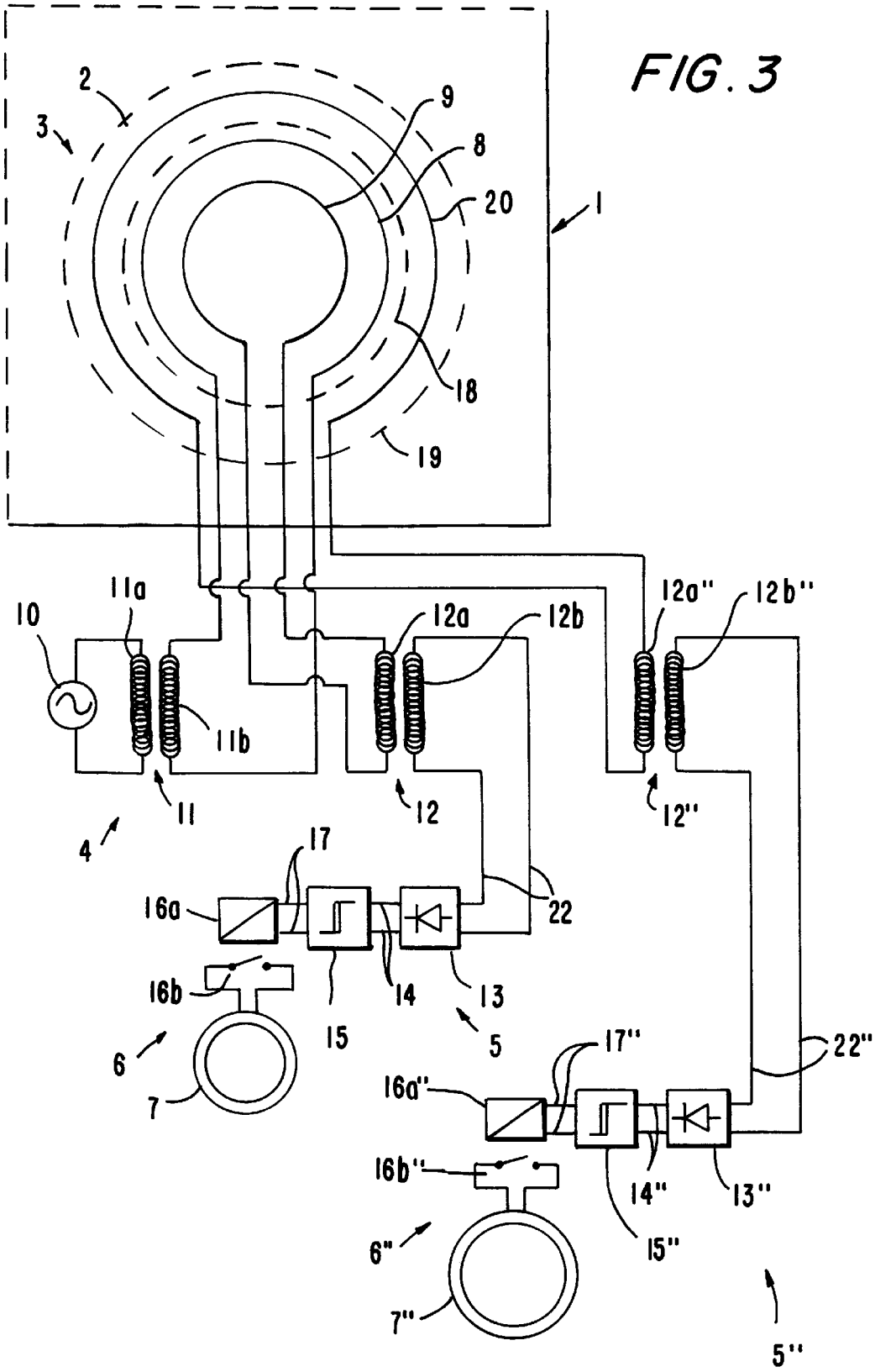
FIG. 3. is the block circuit diagram of a further embodiment of the apparatus for detecting the presence and size of a pot.

FIG. 3 shows an alternative embodiment of the apparatus for detecting the presence and size of pots; elements corresponding to the elements of the exemplary embodiments described in FIGS. 1 and 2 are provided with the same reference numerals. Like the exemplary embodiment of FIG. 2, the embodiment of FIG. 3 is intended for the cooking zone of a stove that is subdivided into two regions and heated by two heating units that can be turned on in addition. The exemplary embodiment of FIG. 3 differs from the embodiment of FIG. 1 in that for each pot size, its own secondary coil with its own evaluation unit is provided.

In FIG. 3, the two heating regions are suggested by dashed lines 18–19. The primary coil 8 and the secondary coil 9 are disposed in the inner heating region 18, and the secondary coil 9 is surrounded by the primary coil 8. The second circular-annular secondary coil 20 is disposed in the outer heating region 19. This coil surrounds the primary coil 8 and the first secondary coil 9 and is also penetrated by the alternating magnetic field of the primary coil 8.

In addition to the evaluation unit 5 and control or switching unit 6 of the first secondary coil 9, this apparatus also has the second evaluation unit 5" and control or switching unit 6" of the same design, which includes the transformer 12", the rectifier 13", the comparator 15", and the relay 16*a"* with the switch contact 16*b"*, which turns the energy supply to the heating unit 7" of the outer heating circuit on and off.

While the comparator 15 of the first evaluation unit 5 compares the voltage induced in the first secondary coil with a first threshold value which is characteristic for a pot that covers the inner heating region 18, in the second comparator 15" of the second evaluation unit 5" a comparison is made with a threshold value which is characteristic for a pot with a larger diameter.

If there is no pot on the cooking zone 2, then the induction voltages of the first and second secondary coils 9, 20 are above both threshold values, and so the switch contacts 16*b* and 16*b"* are opened and both heating units 7, 7" are deactivated. If a pot that covers only the inner region 18 of the cooking zone 2 is put on the stove, then only the first heating circuit is activated by the closure of the first switch contact 16*b*. The second heating circuit is then turned on in addition by the closure of the second switch contact 16*b"* whenever the pot also covers the outer cooking zone 19.

Figure 4:
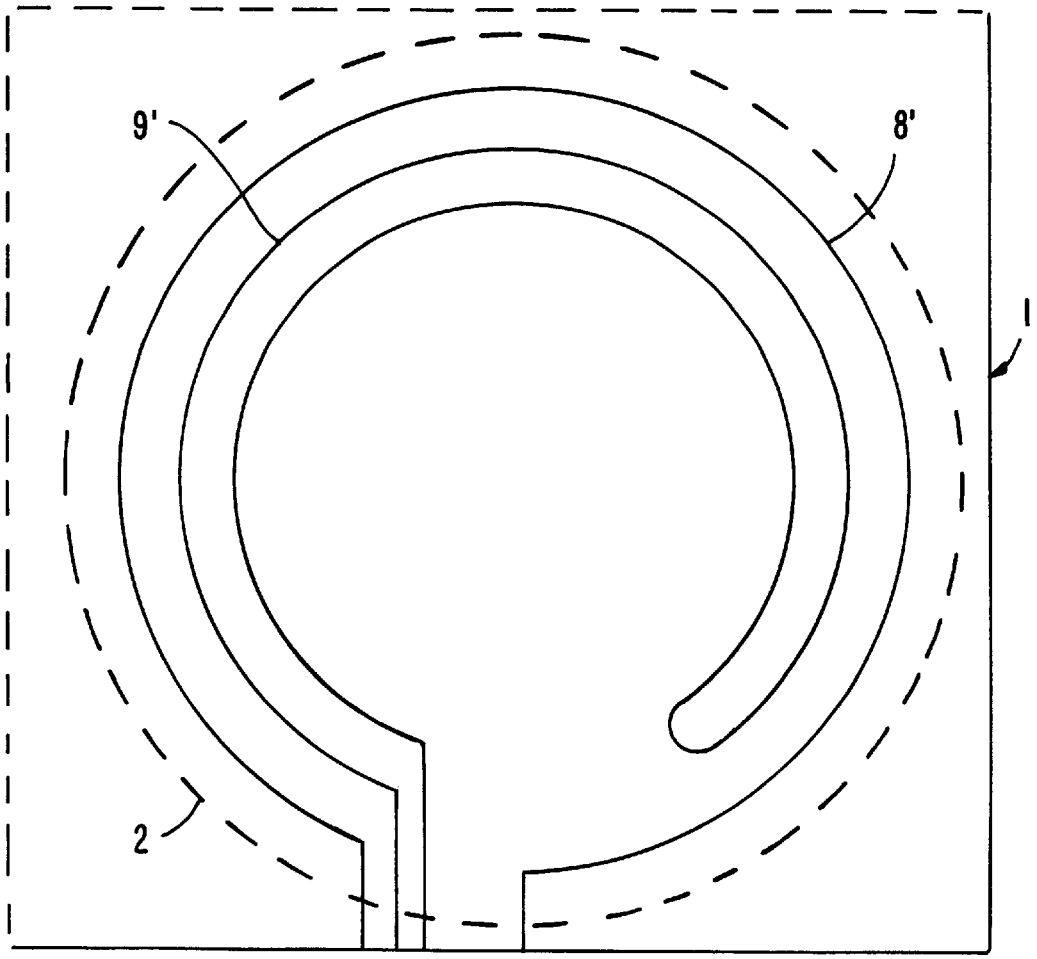
FIG. 4. is a diagram of a further embodiment of the coil arrangement of the apparatus.

FIG. 4 shows a geometric arrangement of conductor tracks of primary and secondary coils 8', 9' in which placing a pot on the cooking zone 2 of the glass ceramic hotplate 1 causes an increase in the voltage induced in the secondary coil 9'. The primary coil 8' has a circular-annular conductor track that extends inside the cooking zone 2. The secondary coil 9' is surrounded by the primary coil 8'. The secondary coil 9' is composed of two segments, which are short-circuited at their ends and extend around the center point of the primary coil 8' over a circumferential angle of approximately 330°.

Figure 5A:
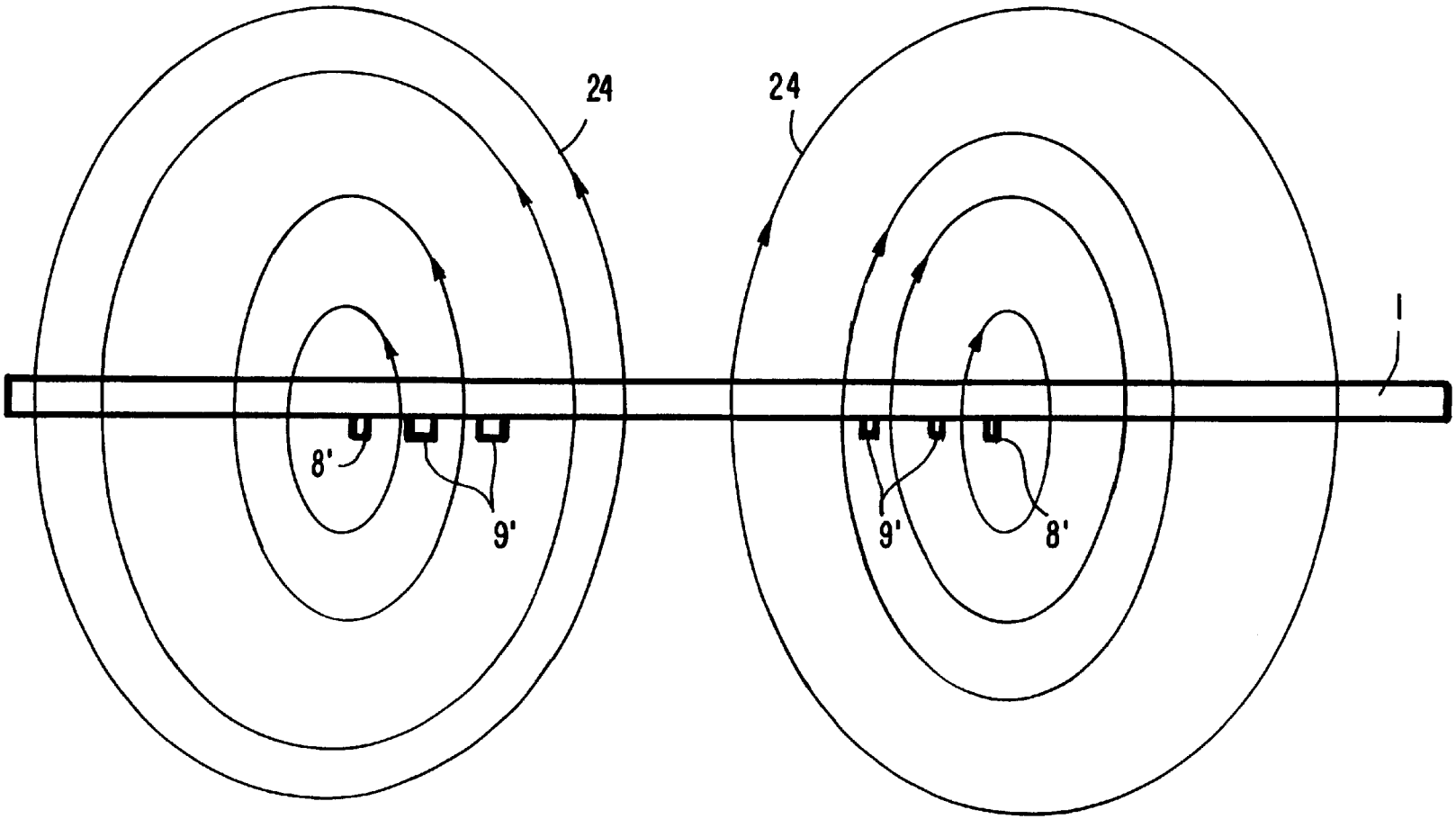
FIG. 5*a*. is a diagram of the field course for the coil arrangement of FIG. 4, with the pot having been removed from the hotplate.

FIG. 5*a* shows the field course of the exemplary embodiment described in conjunction with FIG. 4, where no pot is placed on the hotplate 1. For the sake of clarity, a one-shot display is shown. The field lines of the alternating magnetic field that is generated by the primary coil 8' are identified by reference numeral 24. The self-contained field lines 24 extend inside and outside the area encompassed by the conductor track of the secondary coil 9'.

Figure 5B:
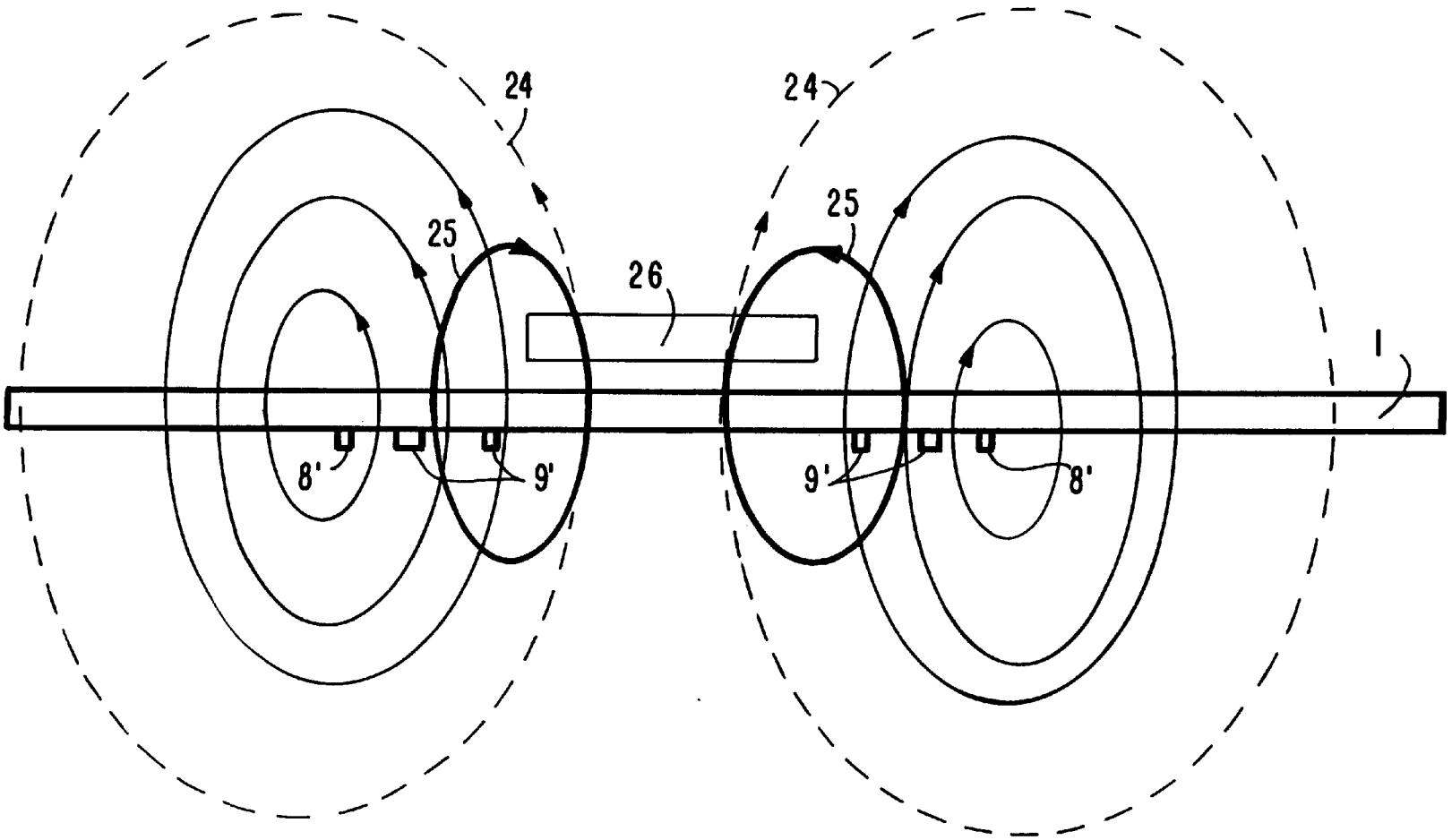
FIG. 5*b*. is a diagram of the field course in the exemplary embodiment of FIG. 4, with the pot placed on the hotplate.

If a cooking pot whose metal base 26 has a smaller outer diameter than the inside diameter of the secondary coil 9' is placed on the hotplate 1, this causes an increase in the voltage induced in the secondary coil 9'. Because of the alternating magnetic field 24 of the primary coil 8', eddy currents that generate a magnetic field counter to the magnetic field are induced in the metal base 26 of the pot. The magnetic field lines of the resultant contrary field are identified in FIG. 5*b* by reference numeral 25.

In the region of the metal base, the alternating magnetic field 25 of the primary coil 8' is attenuated by the resultant contrary field 25. Conversely, in the surrounded region of the secondary coil 9', the field 25 caused by the eddy current in the base of the pot causes an amplification of the alternating magnetic field 24 of the primary coil 8', so that the voltage induced in the secondary coil 9' is increased. With increasing pot size, that is, when the diameter of the pot is greater than the outer diameter of the secondary coil, the resultant contrary field however leads again to a reduction in the alternating magnetic field in the surrounded region of the secondary coil, so that when a pot is put on the stove of the induction voltage of the secondary coil is decreased.

What is claimed is:

1. A cooktop comprising a nonmetallic hotplate (1) with a cooking zone (2), at least one electric heating unit (7, 7') assigned to the cooking zone (2) and a device for detecting a metal pot on the cooking zone (2) when said metal pot is resting on the cooking zone (2), wherein said device for detecting the metal pot includes a measuring sensor (3) arranged in the vicinity of the cooking zone (2) and at least one evaluation device (5, 5") communicating with the measuring sensor (3) and having respective input terminals; said measuring sensor (3) comprises at least one primary measuring coil (8) with respective primary measuring coil terminals **(8*a*,8*b*) and at least one secondary measuring coil (9) with respective secondary measuring coil terminals (9*a*,9*b*); said respective primary measuring coil terminals (8*a*,8*b*) are electrically connected with corresponding poles of an alternating voltage generator (4), said alternating voltage generator (4) comprises means for generating an alternating current in each of said at least one primary measuring coil (8) as well as a magnetic alternating testing field, and said respective secondary measuring coil terminals (9*a*,9*b*)** are connected electrically with corresponding ones of said input terminals of said at least one evaluation device;

wherein said at least one primary measuring coil (8) and said at least one secondary measuring coil (9) are arranged in a common plane so that the at least one secondary measuring coil (9) is penetrated by the magnetic alternating testing field of the at least one primary measuring coil (8), and the at least one evaluation device (5, 5") includes means for monitoring and detecting an induced voltage across said respective input terminals thereof as well as changes in said induced voltage, whereby the presence of said metal pot on the cooking zone (2) is detected as a result of eddy currents produced in said metal pot.

2. The cooktop as defined in claim 1, wherein said nonmetallic hotplate (1) is a glass ceramic hotplate.

3. The cooktop as defined in claim 1, wherein the at least one evaluation device (5, 5") includes a comparator (15) for comparing an input signal proportional to the induced voltage in the at least one secondary measuring coil (9) with a threshold voltage value in order to detect the presence of the metal pot (1) on the cooking zone (2).

4. The cooktop as defined in claim 1, wherein the at least one evaluation device (5, 5") includes a comparator (15') for comparing an input signal proportional to the induced voltage in the at least one secondary measuring coil (9) with several threshold voltage values, in order to determine a size of the metal pot when the metal pot is present on the cooking zone (2).

5. The cooktop as defined in claim 1, wherein the primary and secondary measuring coils (8, 9) of the measuring sensor (3) are embodied as conductor tracks applied to a supporting surface of the nonmetallic hotplate (1).

6. The cooktop as defined in claim 5, wherein the nonmetallic hotplate (1) is a glass ceramic hotplate.

7. The cooktop as defined in claim 5, wherein the conductor tracks of the measuring sensor (3) are embodied as conductor loops.

8. The cooktop as defined in claim 1, wherein the at least one primary measuring coil (8) consists of a single conductor loop encompassing an area located within another area encompassed by another single conductor loop, said at least one secondary measuring coil (9) consisting of said another single conductor loop, and said conductor loops are applied to a supporting surface of said nonmetallic hotplate (1).

9. The cooktop as defined in claim 1, wherein the at least one secondary measuring coil (9) consists of another single conductor loop encompassing another area located within an area encompassed by a single conductor loop, said at least one primary measuring coil (8) consisting of said single conductor loop, and said conductor loops are applied to a supporting surface of said nonmetallic hotplate (1).

10. The cooktop as defined in claim 9, wherein one of said conductor loops is composed of two fragments and each of said two fragments extends on the supporting surface in a side-by-side relationship but are short-circuited at ends thereof remote from said terminals thereof.

11. The cooktop as defined in claim 1, further comprising a control or switching device (6, 6') connected to the at least one electric heating unit (7, 7') and to the at least one evaluation device (5, 5") so that the at least one electric heating unit (7, 7') can be deactivated when the cooking zone (2) is empty.

12. The cooktop as defined in claim 1, wherein the at least one heating unit (7,7') associated with said cooking zone (2) consists of a plurality of the heating units (7, 7') and further comprising at least one control or switching means (6, 6') for activating or deactivating said heating units (7,7') individually as a function of pot size, said at least one control or switching means (6,6') being connected between said heating units (7, 7') and said at least one evaluation device (5, 5").

13. A cooktop comprising a nonmetallic hotplate (1) with a cooking zone (2), at least one electric heating unit (7, 7') assigned to the cooking zone (2) and a device for detecting a metal pot on the cooking zone (2) when said metal pot is resting on the cooking zone (2), wherein said device for detecting the metal pot includes a measuring sensor (3) arranged in the vicinity of the cooking zone (2) and comprising at least one primary measuring coil (8) with respective primary measuring coil terminals **(8*a*,8*b*) and a plurality of secondary measuring coils (9) each having respective secondary measuring coil terminals (9*a*,9*b*); said respective primary measuring coil terminals (8*a*,8*b*) are electrically connected with corresponding poles of an alternating voltage generator (4), said alternating voltage generator (4) comprises means for generating an alternating current in said measuring coil (8) and a magnetic alternating testing field; and respective evaluation devices (5, 5") each having input terminals connected with said terminals of corresponding ones of said secondary measuring coils (9,20)**;

wherein said at least one primary coil (8) and said secondary measuring coils (9,20) are arranged in a common plane so that said secondary measuring coils (9) are penetrated by the magnetic alternating testing field of the at least one primary measuring coil (8), and said respective evaluation devices (5, 5") include comparators (15,15") for comparing induced voltages in said corresponding secondary coils (9,20) with voltage threshold values characteristic of various pot sizes, whereby the pot size of the metal pot on the cooking zone (2) is determined as a result of eddy currents produced in said metal pot.

14. The cooktop as defined in claim 13, wherein said nonmetallic hotplate (1) is a glass ceramic hotplate.

15. The cooktop as defined in claim 13, wherein the primary and secondary measuring coils (8, 9) of the measuring sensor (3) are embodied as conductor loops applied to a supporting surface of the nonmetallic hotplate (1).

16. The cooktop as defined in claim 13, wherein the at least one primary measuring coil (8) consists of a single conductor loop encompassing an area located within another area encompassed by another single conductor loop, said another single conductor loop is one of said secondary coils.

17. The cooktop as defined in claim 13, wherein one of said secondary measuring coils consists of another single conductor loop encompassing another area located within an area encompassed by a single conductor loop, said at least one primary measuring coil (8) consisting of said single conductor loop, and said conductor loops are applied to a supporting surface of said nonmetallic hotplate (1).

18. The cooktop as defined in claim 13, further comprising a control or switching device (6, 6') connected to the at least one electric heating unit (7, 7') and to the at least one evaluation device (5, 5") so that the at least one electric heating unit (7, 7') can be deactivated when the cooking zone (2) is empty.

19. The cooktop as defined in claim 13, wherein the at least one heating unit (7,7') associated with said cooking zone (2) consists of a plurality of the heating units (7, 7'); and further comprising at least one control or switching means (6, 6') for activating or deactivating said heating units (7,7') individually as a function of pot size, said at least one control or switching means (6,6') being connected between said heating units (7, 7') and said evaluation devices (5, 5").

* * * * *